United States Patent [19]

Smith

[11] 4,392,834

[45] Jul. 12, 1983

[54] METHOD FOR AGING A CATHODE OF A CATHODE-RAY TUBE

[75] Inventor: Edgar M. Smith, Millersville, Pa.

[73] Assignee: RCA Corporation, New York, N.Y.

[21] Appl. No.: 265,772

[22] Filed: May 21, 1981

[51] Int. Cl.[3] ..... H01J 9/44

[52] U.S. Cl. ..... 445/6; 445/62

[58] Field of Search ..... 316/1, 24, 26, 27

[56] References Cited

U.S. PATENT DOCUMENTS

| | | | |
|---|---|---|---|
| 1,881,645 | 10/1932 | Jones et al. . | |
| 1,983,668 | 12/1934 | Jones et al. | 250/27.5 |
| 2,561,768 | 7/1951 | Adler | 316/13 |
| 2,917,357 | 12/1959 | Nash et al. | 316/27 |
| 3,357,766 | 12/1967 | Conger | 316/1 |
| 3,698,786 | 10/1972 | Gronka | 316/1 |
| 3,966,287 | 6/1976 | Liller | 316/1 |
| 4,125,306 | 11/1978 | Coble | 316/1 |

*Primary Examiner*—Kenneth J. Ramsey

*Attorney, Agent, or Firm*—Eugene M. Whitacre; Dennis H. Irlbeck; Vincent J. Coughlin, Jr.

[57] ABSTRACT

A method of aging a cathode of an evacuated cathode-ray tube having an electron gun including a heater, a cathode, a control electrode, a screen electrode and a focus electrode is proposed. The cathode and the focus electrode are interconnected. A first potential is applied to the heater while a second potential is applied to the cathode and focus electrode. At the same time, a third potential, more positive than the second potential, is applied to the control electrode. A fourth potential is applied to the screen electrode. A change in the fourth potential is sensed and the sensed change in the fourth potential is used to generate a control signal to vary the first potential to the heater. The aging process is terminated when the control signal causes a predetermined value of the first potential to be achieved. A structure to provide at least some of the above-indicated potentials as well as to sense the change in one of the potentials and to generate the control signal is also disclosed.

2 Claims, 3 Drawing Figures

METHOD FOR AGING A CATHODE OF A CATHODE-RAY TUBE

BACKGROUND OF THE INVENTION

This invention relates to a cathode-ray tube electron gun, and more particularly, to a method and structure for aging the cathode of a cathode-ray tube electron gun to obtain the desired level of cathode emission and tube performance.

It is well known in the art that thermionic cathodes require an "activation" or "aging" step to develop reproducible cathode emmissivity. A typical activation procedure requires that an overvoltage be applied to the filament heater in order to raise the cathode temperature substantially above the normal operating temperature. At the same time an accelerating potential, usually anode potential, is applied to the tube. The activation step is usually continued for a fixed period of time, the activation time being determined by a trial and error evaluation of the tubes. Such an activation procedure is described in U.S. Pat. No. 1,881,645 issued to Jones et al., on Oct. 11, 1932, in U.S. Pat. No. 1,983,668 issued to Jones et al., on Dec. 11, 1934, and in U.S. Pat. No. 2,561,768 issued to Adler, on July 24, 1951.

U.S. Pat. No. 3,357,766 issued to Conger on Dec. 12, 1967 describes an improved method of cathode activation in which the filament heater voltage is reduced from the initial overvoltage while the voltage of one of the prefocus grids is increased. A predetermined sequence of voltages and time intervals is utilized during the activation process.

In each of the above-described activation processes, there is no method for determining whether the desired level of cathode emission has been obtained until the tube is tested. In some tubes the cathodes are "underaged" and the activation process must be repeated. In other tubes the cathodes are "overaged" and some of the low work function cathode material is deposited on the next adjacent electrode, commonly known as the control or $G_1$ electrode, of the electron gun. This deposit of low work function material causes emission from the control grid which appears as a low level area of illumination on the screen of the cathode-ray tube. In tubes such as photorecording cathode-ray tubes used, for example, in CAT scanners, where the screen is photographed, the grid emission induced screen illumination degrades the performance of the tube and must be eliminated.

SUMMARY OF THE INVENTION

A method of aging a cathode of an evacuated cathode-ray tube having an electron gun including a heater, a cathode, a control electrode, a screen electrode and a focus electrode is proposed. The cathode and the focus electrode are electrically interconnected. A first potential is applied to the heater while a second potential is applied to the cathode and focus electrode. At the same time, a third potential, more positive than the second potential, is applied to the control electrode. A fourth potential is applied to the screen electrode. A change in the fourth potential is sensed and the sensed change in the fourth potential is used to generate a control signal to vary the first potential to the heater. The aging process is terminated when the control signal causes a predetermined value of the first potential to be achieved. A structure to provide at least some of the above-indicated potentials as well as to sense the change in one of the potentials and to generate the control signal is also proposed.

DESCRIPTION OF THE PREFERRED EMBODIMENT

Figure 1:
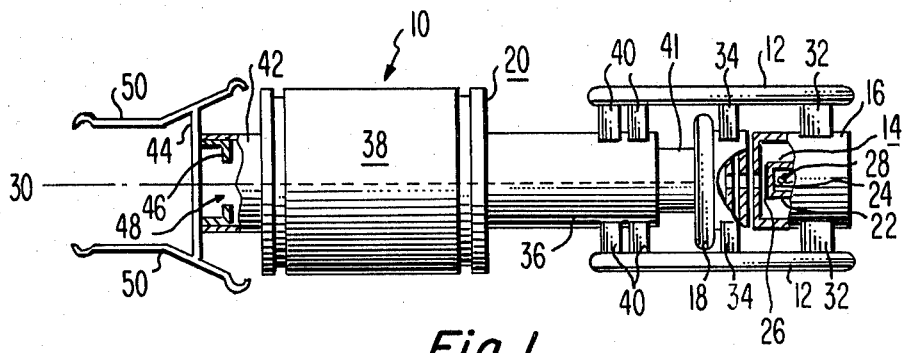
FIG. 1 is a longitudinal view partially broken away of a conventional cathode-ray tube electron gun.

An electron gun 10 of conventional design is shown in FIG. 1. The gun 10 comprises two glass support rods 12, also called beads, upon which various electrodes of the gun are mounted. These electrodes include serially, in the order mentioned, a cathode 14, a control or $G_1$ electrode 16, a screen or $G_2$ electrode 18, and a main lens assembly 20.

The cathode 14 comprises a cathode sleeve 22 closed at the forward end by a cap 24 having an electron emissive coating or pellet 26 thereon. In the preferred embodiment the emissive pellet 26 comprises a porous tungsten substrate impregnated with barium. The cathode 14 is indirectly heated by a heater 28 positioned within the sleeve 22. Electrical connections to the heater 28 are provided by connectors (not shown) well known in the art.

The control and screen electrodes 16 and 18, respectively, are two closely-spaced elements having aligned apertures centered with the cathode 14 along the reference axis 30 of the tube. The control electrode 16 and the screen electrode 18 are attached to the support beads 12 by a pair of support studs 32 and 34 embedded in the support beads 12.

The main lens assembly 20 comprises a main tubular-shaped lower focus or $G_3$ electrode member 36 and a main lens structure 38. The lower focus member 36 is attached to one end of the main lens structure 38, for example by welding, and to the support beads 12 by a plurality of support studs 40 embedded in the support beads 12. A constricted portion 41 of the lower focus member 36 extends within the screen electrode 18 and is closely spaced therefrom. An aperture in the constricted portion 41 is aligned with the apertures in the control and screen electrodes 16 and 18. A tubular anode extension member 42 is attached, for example by welding, to the other end of the main lens structure 38. A bulb spacer support member 44 is attached to the anode extension 42. The bulb spacer support member 44 has a support ledge 46 which telescopes within the anode extension 42 and defines an exit aperture 48. A plurality of bulb contacts 50 are attached to the bulb spacer member 44. The aforementioned electron gun 10 is mounted in the neck of a cathode-ray tube CRT, in a manner well known in the art.

In the manufacturing of a cathode-ray tube, the tube is sealed to an exhaust system (not shown) and heated to a sufficient temperature (about 400° C.) to drive out occluded gases from the tube components. It is also known to heat the electrodes with radio frequency (RF) energy to further outgas the electrodes; however, this step may be omitted if the electrodes have been previously processed to minimize outgassing. For example, the electrodes may be vacuum fired prior to assembly of the electron gun.

After the heating cycle to outgas the tube components, the cathode is activated at an initial heater voltage of approximately 2.0 volts. The heater voltage is gradually increased to about 10 volts in a time period of about 15 minutes. The tube is continually exhausted and maintained at a temperature of about 100° C. during the activation process. The tube is then "tipped-off" from the exhaust system.

Figure 2:
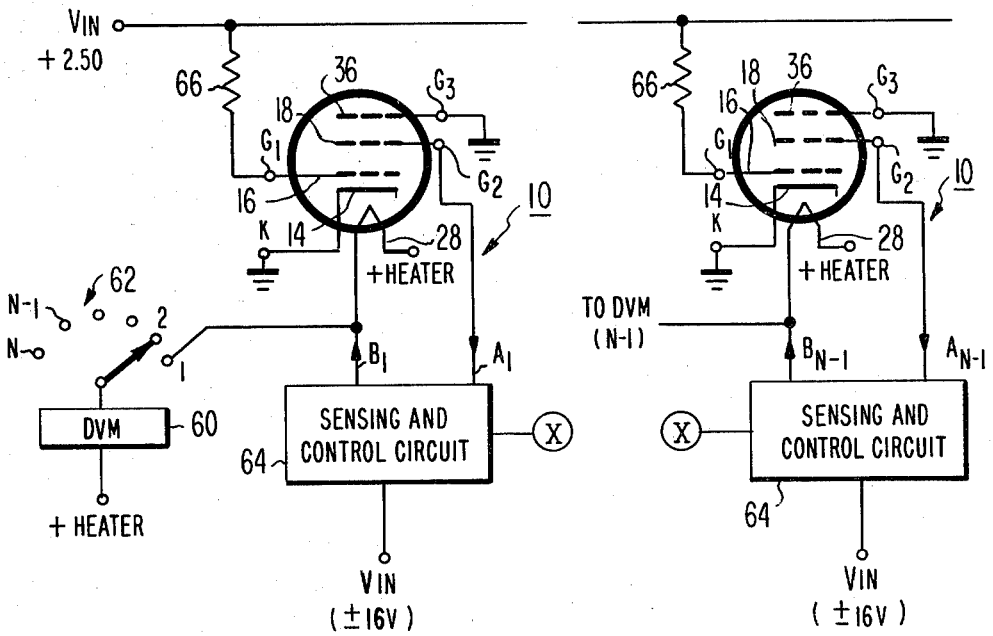
FIG. 2 is a schematic diagram of the novel aging structure.

Subsequent to "tip-off", getters (not shown) mounted within the evacuated tube in a conventional manner are flashed to further lower the pressure within the tube. A base (not shown) is next applied to the tube to facilitate electrical connection to the electrodes within the tube. The tube is now ready for cathode aging. It should be understood that the aging step described hereinafter may be performed before the tube is tipped-off from the exhaust unit; however, since the aging occurs at low electrode current and voltage, the amount of additional gas evolved from the electrodes is minimal and can be absorbed by the getters. Aging the tube after it is removed from the exhaust system permits a greater utilization of the exhaust system by shortening the exhaust cycle time and allowing a greater number of tubes to be exhausted by each exhaust system. With reference to FIG. 2 which shows the novel aging structure for a plurality of cathode-ray tubes, the heater 28, the cathode 14, the $G_1$ control electrode 16, the $G_2$ screen electrode 18 and the $G_3$ focus electrode 36 are shown connected to a plurality of potentials. One terminal of the heater 28 is connected to a positive heater potential while the other terminal is connected to a negative potential, the value of which is determined by a novel sensing and control circuit 64, to be described hereinafter. The voltage across the heater 28 may be measured by a digital voltmeter 60 through a selector switch 62. Potentials applied to the cathode-ray tube and to the novel sensing and control circuit 64 are from conventional power supplies and are of the magnitude indicated in the drawings or described below. The cathode 14 and the $G_3$ electrode 36 are interconnected to ground potential. The $G_1$ electrode 16 is connected to an acceleration potential of 2.50 volts through a resistor 66. The resistor 66 has a nominal value of about 220 ohms.

The $G_2$ electrode 18 acts as the collector or sensing element for aging the cathode 14. The sensing and control circuit 64 is shown schematically in FIG. 3. One sensing and control circuit 64 is required for each tube that is being aged. The sensing and control circuit 64 comprises three portions: a sensing circuit 68, a limit circuit 70 and a control circuit 72. The sensing circuit 68 senses and amplifies the signal sensed on the $G_2$ electrode 18. The sensed signal is applied to the sensing circuit 68 at input $A_N$. The limit circuit 70 is used to automatically terminate the aging cycle by turning off the base current to a heater voltage-control transistor 74 when the sensed signal reaches a value which causes a decrease in the heater voltage to a predetermined value. The control circuit 72 decreases the voltage applied to the heater 28 over the heater terminal connected to control circuit output $B_N$ in response to the sensed signal at input $A_N$.

Figure 3:
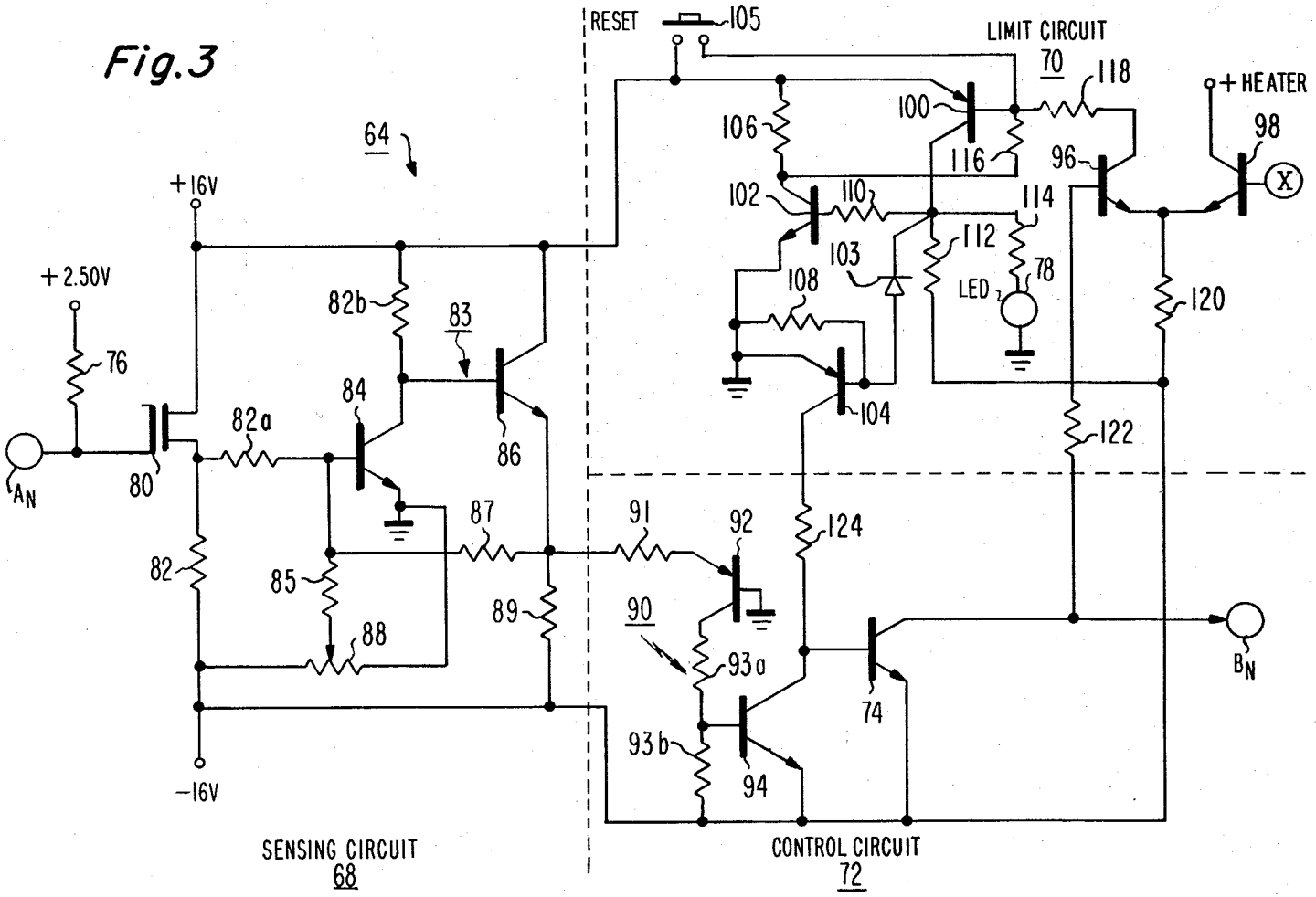
FIG. 3 is a detailed schematic diagram of the novel sensing and control circuits of FIG. 2.

With reference to FIGS. 2 and 3, during the aging process a cathode ray-tube is connected as described above. The heater input, +heater, from a power supply (not shown), is initially adjusted to provide a voltage of such a magnitude as to initially establish a heater voltage of 7.5 volts to the heater 28. With the selector switch 62 set to indicate the position of the tube being aged, the heater voltage of 7.5 volts will be displayed on the voltmeter 60.

Before any current is drawn in the cathode ray-tube, the cathode 14 and the $G_3$ electrode 36 are at ground potential and 2.50 volts is applied over resistor 66 to the $G_1$ electrode 16. Also, 2.50 volts is applied over a one megohm sensing resistor 76 to the $G_2$ electrode 18. When the heater 28 raises the emissive coating 26 on the cathode sleeve 22 to emission temperature, electron emission from the cathode 14 occurs. The emitted electrons are accelerated by the potential on the $G_1$ electrode 16. Some of the electrons from the cathode 14 pass through the $G_1$ aperture and are collected by the $G_2$ electrode 18.

As current is drawn by the $G_2$ electrode 18, a voltage drop occurs across the sensing resistor 76. Assume, for example, that the $G_2$ electrode 18 draws one microampere of current. Since the sensing resistor 76 has a value of one megohm, one volt is dropped across the resistor 76 with a resultant decrease in the potential applied to the $G_2$ electrode 18, and a change in the sensing circuit 68 from the initial "no-current flow" condition. The decreased potential applied to the sensing circuit 68 is coupled to the control circuit 72 to provide a decrease in the control potential applied to the terminal of the heater 28 over output $B_N$. Despite the fact that the heater voltage is being decreased, the emissivity of the cathode coating 26 continues to increase with a corresponding increase in electron emission and a subsequent increase in current flow to the $G_2$ electrode 18. The aging cycle continues until the flow of current to the $G_2$ electrode 18 and the corresponding voltage drop over the sensing resistor 76 reduces the voltage to the sensing circuit 68 and decreases the heater voltage to the heater 28 to a preestablished heater voltage, e.g., 6.7 volts. At 6.7 volts, the limit circuit 70 electrically opens the control transistor 74, activates an LED 78 to indicate that the aging cycle is complete, and removes the heater voltage from the heater 28 of the tube under test.

It has been observed that cathodes aged using the above-described novel method and structure achieve the desired level of cathode emissivity within a time range of one to eight hours.

Merely by way of illustration and in no sense by way of limitation, there is illustrated in FIG. 3 a schematic diagram of one form of sensing and control circuit 64 which has been found suitable for performing the novel process provided by the present invention. In the sensing and control circuit 64, the sensing circuit 68 includes a high input resistance device 80, such as a FET connected in a source-follower configuration. The change in the potential on the $G_2$ electrode 18, applied to the sensing circuit 68 at input $A_N$, is applied to the gate of the FET 80. The potential at input $A_N$ is thus developed as a voltage across a source resistor 82. This voltage is applied to a two-stage direct-coupled sensing amplifier 83 with negative feedback. The sensing amplifier comprises a pair of transistors 84 and 86, a load resistor 82 and feedback resistors **82*a* and 87. The gain of the sensing amplifier 83 is determined by the amount of negative feedback. The dc output level of the sensing amplifier 83 is adjustable by means of a variable resistor 88 and a current limiting resistor 85 to compensate for variations in the self-bias potential of the FET 80 and to establish suitable operating limits, within the recommended operating range of the components, for the control circuit 72**.

The output of the sensing amplifier 83 is applied to the control circuit 72 through a voltage shifter 90. The voltage shifter 90 comprises a current limiting resistor 91, an input transistor 92, a pair of current limiting resistors 93*a* and 93*b* and a second transistor 94, the collector of which is attached to the base of the heater control transistor 74. The voltage shifter 90 shifts the output dc level of the sensing amplifier 83 to the level required to control the base current of the heater voltage-control transistor 74. The operation of the sensing circuit 68 and the control circuit 72 is such that a less positive potential on the $G_2$ electrode 18, and thus at input $A_N$, causes a decrease in the base current of the heater voltage-control transistor 74, producing a reduction in the control voltage across the heater 28 over output $B_N$.

The limit circuit 70 consists of a two-transistor voltage comparator 96 and 98, a two-transistor regenerative switch 100 and 102, a diode 103, a buffer transistor 104, a plurality of limit circuit resistors 106–122 and a LED 78 connected to the two transistor regenerative switch. In the operation of the limit circuit 70, a reset switch 105 is engaged after a cathode-ray tube is connected in the manner shown in FIG. 2. The regenerative switch 100, 102, through the buffer transistor 104 and the current control resistor 124, turns on the base current to the heater voltage-control transistor 74 which, in turn, applies the control voltage to heater 28. In the absence of cathode emission, the heater voltage is set, for example at 7.5 volts. As cathode emission increases, i.e., as the aging processing proceeds, the heater voltage decreases by the action of the cotrol circuit 72 described above. When the heater voltage decreases to a level, corresponding to the preestablished reference voltage at X, which, for example, is 6.7 volts, the base voltages to the voltage comparator transistors 96 and 98 are equal and the comparator 96 and 98 causes the regenerative switch 100 and 102 to change state and turn-off the base current to the heater voltage-control transistor 74 thereby removing the voltage to heater 28. The diode 103 disconnects the buffer transistor 104 after the change of state of the regenerative switch 100, 102 and maintains this condition until the reset switch 105 is reactivated. The LED 78 is simultaneously energized to indicate the termination of the aging process.

In the above-described embodiment of the sensing and control circuit 64, the components indicated below had the stated values:

| | | |
|---|---|---|
| 76 | 1 Mohms, | ¼ watts, 10% |
| 80 | 2N4416 | |
| 82, 82a, 82b | 10 kohms, | ¼ watts, 10% |
| 85, 118 | 47 kohms, | ¼ watts, 10% |
| 87, 91 | 27 kohms, | ¼ watts, 10% |
| 88 | 0–100 kohms, | ¼ watts, 10% |
| 89, 93b, 106, 108, 112, 116 | 10 kohms, | ¼ watts, 10% |

-continued

| | | |
|---|---|---|
| 93a | 33 kohms, | ¼ watts, 10% |
| 110, 122 | 22 kohms, | ¼ watts, 10% |
| 114 | 3.9 kohms, | ¼ watts, 10% |
| 120 | 270 ohms, | ¼ watts, 10% |
| 124 | 820 ohms, | ¼ watts, 10% |
| 74, 84, 86 | 2N3565 | |
| 94, 102, 96, 98 | 2N3565 | |
| 92, 100, 104 | 2N5139 | |
| 103 | 1N914 | |

The reference voltage at X, obtained from a regulated voltage supply (not shown), determines the duration of the aging cycle. The value of the predetermined voltage at X, is established by observing the performance of a number of tubes during testing. The predetermined voltage at X may be adjusted to consistently provide the required level of emission within a reasonable aging time.

It should be clear to one skilled in the art that the above-described cathode aging process and structure may be modified in a number of ways. For example, the sensed potential on the $G_2$ electrode 18 may be monitored until a predetermined emission current is achieved at a fixed heater voltage, e.g., 7.5 volts. The aging process may be terminated when the predetermined emission current is obtained. The problem with this method of aging is that it does not take into account the cathode variations from tube-to-tube or that the continuous overvoltage on the heater 28 may provide the predetermined emission current before the cathode is properly aged resulting in an "underaged" cathode.

What is claimed is:

1. A method of aging a cathode of an evacuated cathode-ray tube having an electron gun for generating at least one electron beam, said electron gun including a heater, a cathode, a control electrode, a screen electrode and a focus electrode, said method comprising the steps of:

interconnecting said cathode and said focus electrode, applying a first potential to said heater, applying a second potential to said cathode and said focus electrode, applying a third potential, more positive than said second potential, to said control electrode, applying a fourth potential to said screen electrode, sensing a change in said fourth potential, generating a control signal from said sensed change in said fourth potential, using said control signal to vary said first potential to said heater, and terminating said aging process when said control signal causes a predetermined value of said first potential to be achieved.

2. The method as in claim 1, wherein said second potential is ground potential.

* * * * *

UNITED STATES PATENT AND TRADEMARK OFFICE

CERTIFICATE OF CORRECTION

PATENT NO. : 4,392,834

DATED : July 12, 1983

INVENTOR(S) : EDGAR MERLE SMITH

It is certified that error appears in the above-identified patent and that said Letters Patent is hereby corrected as shown below:

Column 2, Line 38 - "main" (second occurrence) should be deleted;

Column 4, Line 59 - "82" should be -- 82b -- ;

Column 5, Line 32 - "processing" should be -- process -- ; and

Column 5, Line 33 - "cotrol" should be -- control -- .

Signed and Sealed this

*Eighteenth* Day of *October 1983*

[SEAL]

*Attest:*

GERALD J. MOSSINGHOFF

*Attesting Officer*

*Commissioner of Patents and Trademarks*